United States Patent [19]

Reedy

[11] Patent Number: 4,727,727

[45] Date of Patent: Mar. 1, 1988

[54] INTEGRATED HEAT PUMP SYSTEM

[75] Inventor: Wayne R. Reedy, Cazenovia, N.Y.

[73] Assignee: Electric Power Research Institute, Inc., Palo Alto, Calif.

[21] Appl. No.: 17,167

[22] Filed: Feb. 20, 1987

[51] Int. Cl.[4] ..... F25B 27/00

[52] U.S. Cl. ..... 62/238.6; 62/238.7; 62/278

[58] Field of Search ..... 62/79, 80, 81, 82, 278, 62/238.6, 238.7, 160

[56] References Cited

U.S. PATENT DOCUMENTS

| | | | |
|---|---|---|---|
| 4,158,950 | 6/1979 | McCarty | 62/278 |
| 4,399,664 | 8/1983 | Devosier | 62/238.6 X |
| 4,493,193 | 1/1985 | Fisher | 62/238.6 X |
| 4,598,557 | 7/1986 | Robinson et al. | 62/238.6 |
| 4,625,524 | 12/1986 | Kimura et al. | 62/278 |
| 4,646,537 | 3/1987 | Crawford | 62/238.6 |

*Primary Examiner*—Lloyd L. King
*Attorney, Agent, or Firm*—Bruns and Wall

[57] ABSTRACT

An integrated heat pump and hot water system having a refrigerant to water heat exchanger that includes first and second refrigerant circuits in heat transfer relation with a hot water circuit for circulating water from a storage tank through the heat exchanger. One refrigerant circuit is connected between the discharge side of the refrigerant compressor and the heat pump reversing valve. The second circuit is connected between the suction side of the compressor and the indoor coil side of the heat pump expansion device. A pair of control valves are positioned to provide for water heating when the heat pump is in either a heating or cooling mode of operation or, alternatively, when the heat pump is not required to provide air conditioning. In addition, energy in the hot water on the water side of the system is used to evaporate refrigerant in a novel defrost cycle.

11 Claims, 1 Drawing Figure

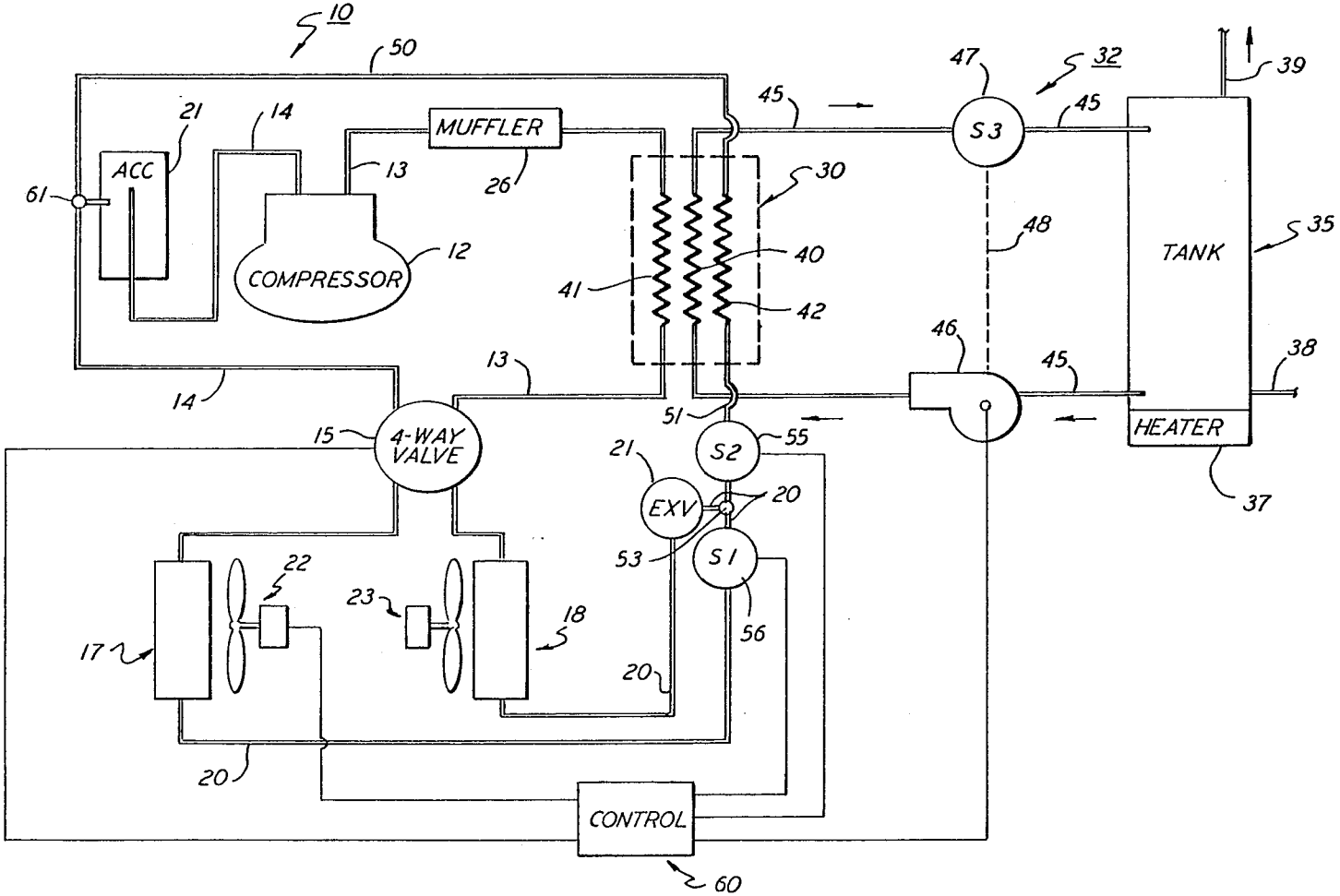
TANK
HEATER
S3
S2
S1
EXV
CONTROL
MUFFLER
COMPRESSOR
4-WAY VALVE
ACC

INTEGRATED HEAT PUMP SYSTEM

BACKGROUND OF THE INVENTION

This invention relates to an improved heat pump and in particular, to an integrated heat pump and hot water system having a defrost cycle wherein the indoor coil is thermodynamically isolated from the system and energy from the hot water side of the system is used to evaporate refrigerant during the defrost cycle.

Integrated heat pump and hot water systems have been known and used in the art for some time. Typically, a desuperheater is placed in the discharge line of the refrigerant compressor and the exchanger configured so that superheat in the refrigerant leaving the compresssor is rejected into water passing through the exchanger. The amount of energy that can be provided to the water side of the system is usually limited to the amount of superheat available in the refrigerant leaving the compressor. This type of system furthermore cannot produce hot water unless the heat pump is delivering heating or cooling to a comfort zone. U.S. Pat. No. 4,311,498 to Miller shows a typical integrated heat pump and hot water system having a desuperheater for providing energy to the water side of the system.

In U.S. Pat. No. 4,598,557 to Robinson et al. there is disclosed a heat pump that is integrated with a domestic hot water system through means of a refrigerant to water heat exchanger that is operatively connected into the discharge line of the refrigerant compressor. Three different heat pump configurations can be obtained by selectively opening and closing a relatively large number of valves. In two configurations the heat pump delivers heating and cooling to an indoor comfort zone with or without heating water. In a third configuration the system is arranged to provide water heating only without any air conditioning. This is accomplished by manipulating the control valves to physically remove the indoor coil from the refrigeration side of the system. The refrigeration to water heat exchanger, in this third configuration, takes over the entire condensing load of the system and uses the heat of condensation to heat domestic water.

Although the Robinson et al. device represents an advancement in the art in that it provides for water heating during periods when air conditioning is not required, it never-the-less requires a good deal of additional equipment to produce three separate system configurations. Each configuration, because it is separated from the others, utilizes its own dedicated expansion device. More importantly, however, to establish any one configuration it is necessary to valve off entire sections of the refrigeration system. As a consequence, unused refrigerant in varying amounts becomes trapped in the isolated sections thereby making refrigeration management extremely difficult. While the proper amount of refrigerant might be available to operate the heat pump efficiently in one of the three configurations, the situation can change dramatically when the heat pump is changed over to one of the other configurations.

It should be further noted that the Robinson et al. compressor is unfortunately arranged to pump against the valves used to shut off various sections of the refrigeration system. High refrigerant pressures, coupled with normal wear on the valve parts, allows refrigerant to leak past the valve, further compounding refrigeration inventory problems. The Robinson et al. system, like other heat pump systems found in the prior art, must also employ inefficient strip heaters or the like to prevent cold air from being blown into a comfort air region during a defrost cycle.

SUMMARY OF THE INVENTION

It is therefore an object of the present invention to improve integrated heat pump and hot water systems.

It is a further object of the present invention to provide an improved integrated heat pump and hot water system that eliminates the need for strip heaters or the like when the outdoor coil is being defrosted.

A still further object of the present invention is to provide an integrated heat pump and hot water system that efficiently uses energy from the hot water side of the system to periodically defrost the outdoor coil.

Another object of the present invention is to eliminate refrigeration management and inventory problems in integrated heat pump and hot water systems.

While it is still another object of the present invention to provide a heat pump that can be adapted to heat water efficiently using a mimimum amount of component parts.

These and other objects of the present invention are attained by means of an integrated heat pump and hot water system that includes a refrigerant to water heat exchanger having a water current for bringing a flow of water into heat transfer relationship with two separate refigerant flow circuits whereby energy is transferred freely between the three circuits. The first refrigerant flow circuit is connected in a series between the discharge side of the refrigerant compressor and the heat pump reversing valve.

The second refrigerant flow circuit is connected in series between the suction side of the compressor and the line connecting the indoor coil and the outdoor coil. A connector is placed in the line between the heat pump expansion device and the indoor coil through which refrigerant moving through the liquid line is selectively shunted back to the compressor through the second refrigerant flow circuit. With the aid of only two additional control valves, refrigerant can be cycled through the heat pump side of the system to provide six different modes of operation including a novel defrost cycle wherein energy stored in the water is used to defrost the outdoor coil. All refrigerant lines, whether being used in an operational mode or not, are exposed to the suction side of the compressor, thus enabling all available refrigerant to be utilized in any selected mode to eliminate refrigeration management and inventory problems.

BRIEF DESCRIPTION OF THE DRAWING

For a better understanding of these and other objects of the present invention reference is made to the following detailed description of the invention that is to be read in conjuction with the drawing which is a diagramatic representation of an integrated heat pump and hot water system embodying the teachings of the present invention.

DESCRIPTION OF THE INVENTION

Referring now to the drawing, there is shown a conventional heat pump system generally referenced 10. The heat pump includes a refrigerant compressor 12 of any suitable design for bringing refrigerant in the system to the desired operating temperatures and pressures. The discharge line 13 and the primary suction line 14 of the compressor are both connected to a four way reversing valve 15. The reversing valve is also connected to an indoor fan coil unit 17 and an outdoor fan coil unit 18 whereby the flow of refrigerant delivered by the compressor to the fan coil units can be reversed by cycling the four-way valve. The opposite sides of the fan coil units are interconnected by a liquid or two phase refrigerant line 20 (hereinafter referred to simply as the liquid line) to close the refrigerant flow loop. A two way expansion device 21 is operatively connected into the liquid line to throttle or expand liquid refrigerant as it moves between the fan coil units.

The indoor and outdoor fan coil units are provided with motor driven fans 22 and 23, respectively, which force air over the heat exchanger surfaces, thereby causing energy to be exchanged between the refrigerant and the surrounding ambient. It should be understood that the indoor fan coil unit is typically situated within an enclosed comfort zone that is being conditioned and the outdoor fan coil unit is remotely situated from the comfort zone, as for example, out of doors.

To provide heating to the comfort zone, the four-way reversing valve 15 is cycled to connect the discharge line of the compressor to the indoor fan coil unit, whereby energy in high temperature refrigerant leaving the compressor is condensed ,and the energy (heat) rejected into the comfort zone. The outdoor fan coil acts as an evaporator in this mode of operation, whereby heat from the surrounding ambient is acquired to evaporate the refrigerant as it is returned to the compressor. Cooling is provided to the comfort zone by simply cycling the four way valve to a position that reverses the function of the two fan coil units.

A muffler 26 may be placed in the discharge line 13 of the compressor to supress compressor noise. An accumulator tank may also be placed in the suction line 14 of the compressor to collect liquid refrigerant as it is being returned to the compressor.

A refrigerant to water heat exchanger 30 is placed in the discharge line of the refrigerant compressor which permits energy to be exchanged between the heat pump 10 and a hot water circulating system, generally referenced 32. The hot water system can include a conventional domestic hot water tank 35 of the type usually found in homes, small commercial buildings and the like. The tank 35 includes an upper water storage area 36 and a lower heating unit 37 that can be activated by a thermostatic control (not shown) to provide heat to the water stored in the tank. Water is brought into the storage tank from a municipal water source, well, or the like via inlet line 38 and is drawn from the tank on demand via an outlet line 39. As will be explained in greater detail below, the tank heater in the present system is held inactive anytime the heat pump is operating, whereupon the entire heating demand of the hot water system is supplied by the heat pump. Typically, the stored water is heated to a temperature of about 120° degrees F.

The heat exchanger 30 contains three flow circuits that are placed in heat transfer relationship with one another so that energy in the flow streams can move freely from one circuit to another. The circuits include a water circuit 40, a first refrigerant condensing circuit 41, and a second refrigerant evaporating circuit 42. The water circuit is connected in series with the storage tank by a water line 45 that forms a circulating loop by which water is drawn from the lower part of the tank and returned to the upper part of the tank as indicated by the arrows. A pump 46 and a solenoid actuated valve 47, are connected into the water line as illustrated. The valve and the pump are electrically connected by line 48, so that any time the pump is turned on the valve will be opened and water from the storage tank is circulated through the heat exchanger. Deactivating the pump causes the valve to close, thus isolating the water tank from the heat exchanger.

The first refrigerant flow circuit 41 is connected into the discharge line of the compressor between the compressor and the four way reversing valve 15. Accordingly, anytime the heat pump is operating, high temperature refrigerant leaving the compressor is passed through the first refrigerant flow circuit 41 of the heat exchanger 30.

The second refrigerant flow circuit 42 is connected in series between the suction side of the compressor via a secondary suction line 50 and a connection 53 contained in the liquid line via a return line 51. The connection 53 is located in the liquid line at some point between the indoor coil unit 17 and the expansion device 21.

A solenoid actuated valve 55 is contained in the return line 51 between the expansion device and the second refrigeration flow circuit 42. A similar solenoid actuated valve 56 is connected in the liquid line between the connector 53 and the indoor fan coil unit 17. The solenoid valves are electrically wired to a control unit 60 along with the indoor fan 22 and the flow reversing valve 15. As will be explained in greater detail below, the valves are opened and closed in a desired order to selectively route refrigerant through the system.

Air Conditioning With or Without Hot Water Heating

During normal air conditioning (heating or cooling) operations, solenoid valve 56 is opened by the control unit and at the same time valve 55 is closed. Both fans 22 and 23 are placed in an operative position and refrigerant is routed through the heat pump to provide either heating or cooling to the comfort zone in response to the positioning of the reversing valve. The control unit is adapted to periodically turn on the water pump 46 and opens water valve 47 to circulate water from the tank through the water loop when water heating is required. By design, part of the heat contained in the refrigerant vapor leaving the compressor is transferred into the water being pumped through the water loop. The remaining energy in the refrigerant is passed on to one of the fan coil units where the refrigerant is fully condensed in a normal manner to a saturated liquid. The energy in the compressor discharge flow is thus available for both heating water in the hot water side of the system and to satisfy the heating demands of the heat pump. The amount of energy exchanged is a function of the available heat transfer surface area, the flow rates of the working substances, and the amount of work that the heat pump is called upon to perform during selected heating or cooling operations.

Water Heating Without Air Conditioning

In the event additional hot water is required during periods when comfort air conditioning is not needed, the fan 22 of the indoor fan coil unit is turned off by the control unit to eliminate heat transfer from the heat pump to the comfort zone. Valve 56 is held open by the control unit and valve 55 remains closed. The water pump is turned on as explained above and the heat pump is cycled to the heating mode of operation.

In this configuration, the refrigerant to water heat exchanger acts as a full condenser and the water is permitted to remove as much energy from the refrigerant as it needs to satisfy the demands placed on the hot water system. Although not shown, a hot water thermostat senses the water temperature in the storage tank and shuts down the system when a desired water temperature is reached.

Outdoor Defrost Cycle

The apparatus of the present invention is provided with a novel defrost cycle which utilizes hot water available in the storage tank to efficiently defrost the outdoor fan coil during a periodic defrost cycle without producing the "cold blow" generally associated with other heat pump units. In a heat mode of operation the outdoor coil acts as a refrigerant evaporator, and, as a result, the coil surfaces become coated with frost or ice. Conventionally, the heat pump is switched periodically to a cooling mode wherein the outdoor coil acts as a condensor to remove any frost build-up. At the same time, the indoor coil acts as a refrigerant evaporator to remove heat from the comfort zone. The coil thus blows unwanted cool air into the comfort zone. In order to offset the cold blowing effect in a conventional system, electrical strip heaters are placed in the air duct that conducts conditioned air over the indoor coil. The heaters are arranged to come on when a defrost cycle is initiated and are turned off when the cycle is terminated. As is well known in the art, reversing the heat pump cycle and utilizing electrical strip heaters is highly inefficient and increases the cost of operating the heat pump.

In the present integrated system, the previously heated water, which is stored in the tank at between 120° degrees F. and 140° degrees F., is used to provide energy to the refrigerant during a defrost cycle. To utilize this relatively inexpensive and readily available energy in a defrost cycle, the present heat pump is placed in a cooling mode by the control unit, valve 56 is closed and valve 55 is opened. At the same time the water pump is cycled on. Accordingly, the refrigerant to water heat exchanger 30 now serves as the heat pump evaporator. High temperature refrigerant discharged by the compressor is delivered to the outdoor coil where the heat of condensation is used to remove any ice that might be present on the coil surfaces. Upon leaving the outdoor coil, the refrigerant is throttled through the expansion device 21 in a normal manner, but rather than being delivered to the indoor coil as in a conventional defrost cycle, the throttled refrigerant is applied to the evaporating circuit 42 in heat exchanger 30. Here liquid refrigerant absorbs sufficient heat from the hot water loop to evaporate the refrigerant. The refrigerant vapor leaving the heat exchanger is then drawn into the suction side of the compressor via the secondary suction line 50 that joins the primary suction line 14 at the entrance 61 to the accumulator.

As can be seen, use of this novel defrost cycle eliminates the need for inefficient strip heaters, and because the indoor coil is taken out of the cycle, there is no objectional cold air blown into the comfort zone during the defrosting operation. Although energy is taken out of the hot water side of the system during the defrost cycle, this energy is eventually replaced at little cost when the heat pump is returned to a normal heating mode. This is achieved by simply allowing the water pump to continue to run until such time as the water supply once again reaches a desired storage termperature.

The integrated system of the present invention, through use of only two additional control valves, is capable of delivering six different operational modes. These include heating with or without water heating, cooling with or without water heating, heating of water without air conditioning, and a novel defrost cycle which efficiently uses energy stored in the hot water side of the system to evaporate refrigerant. It should be further noted that in all configurations the suction side of the compressor is connected to any refrigerant circuit that is not being used in a selected configuration. The compressor thus serves to remove refrigerant from the isolated circuit, and accordingly the refrigerant management and inventory problems generally found in other integrated systems are avoided.

While this invention has been described with respect to certain preferred embodiments, it should be recognized that the invention is not limited to those embodiments, and many variations and modifications would be apparent to those of skill in the art, without departing from the scope and spirit of the invention, as defined in the appended claims.

I claim:

1. An integrated heat pump and hot water system that includes a heat pump having an indoor heat exchanger and an outdoor heat exchanger that are selectively connected to the suction line and the discharge line respectively of a compressor by a flow reversing means, and to each other by a liquid line having an expansion device mounted therein, whereby heating and cooling is provided to an indoor comfort zone by cycling the flow reversing means, a refrigerant to water heat exchanger having a hot water flow circuit in heat transfer relation with a first refrigerant condensing circuit and a second refrigerant evaporating circuit, said first refrigerant condensing circuit being connected in series with the discharge line of the compressor and the flow reversing means, a connection mounted in the liquid line between the indoor heat exchanger and the expansion device, said second refrigerant evaporating circuit being connected in series between the suction line of the compressor and said connection in the liquid line, and control means for regulating the flow of refrigerant through the refrigerant to water heat exchanger to selectively transfer heat into and out of the hot water flow circuit.

2. The system of claim 1 wherein said control means further includes a first valve positioned in the liquid line between the indoor heat exchanger and said connection and a second valve positioned in a return line running from said connection to the second refrigerant evaporating circuit.

3. The system of claim 1 wherein said indoor heat exchanger further includes a fan means for moving comfort air over the heat exchanger surfaces and said control means is adapted to periodically switch said fan off to isolate the indoor heat exchanger when the system is in a heating mode of operation whereby the entire condensing load of the heat pump is carried by the condensing circuit.

4. The system of claim 1 wherein said water flow circuit is connected into a water line arranged to circulate water from a storage means through said water flow circuit.

5. The system of claim 4 that further includes a pump in the water line that is turned on and off by said control mean.

6. The system of claim 4 that further includes a secondary heater means for raising the temperature of the water in said storage means when the heat pump is not in operation.

7. The system of claim 2 wherein the control means is adapted to cycle the first and second valves to periodically route refrigerant passing through the condensing circuit sequentially through the outdoor heat exchanger, the expansion means and the evaporator circuit whereby the outdoor coil is defrosted and the refrigerant returning to the compressor is evaporated by energy stored in the hot water.

8. In a heat pump system containing an indoor fan coil unit and an outdoor fan coil unit that are selectively connected on one side to either the suction line or the discharge line of a compressor by a reversing valve and on the other side by a liquid line containing an expansion valve whereby the flow of refrigerant through the system can be reversed to provide either cooling or heating to an indoor comfort zone, the improvement comprising a liquid to refrigerant heat exchanger having a water circuit that is in heat transfer relation with a first refrigerant condensing circuit and a second refrigerant evaporating circuit whereby energy in the condensing circuit is transferred into the water circuit and energy in the water circuit is transferred into the evaporating circuit, said condensing circuit being connected at one side to the discharge line of the compressor and at the other side to the reversing valve whereby a portion of the energy in the refrigerant leaving the compressor is available to heat water passing through the water circuit, said water circuit being connected into a hot water system, said evaporating circuit being connected into an evaporator line that is joined at one end to the liquid line between the indoor fan coil unit and the expansion valve and at the other end to the suction line of the compressor, a first control valve positioned in the liquid line between the evaporator line and the indoor fan coil unit, a second control valve in the evaporator line positioned between the liquid line and the evaporating circuit, and control means for normally holding the first valve in an open condition and the second valve in a closed condition when heating or cooling is being provided to the comfort zone and for periodically closing said first valve and opening said second valve to defrost the outdoor coil whereby energy in the hot water system is used to evaporate refrigerant as it is being returned to the compressor through the refrigerant evaporating circuit.

9. The improvement of claim 8 wherein said hot water system includes a storage tank and a pump means for moving water from the tank through the water circuit.

10. The improvement of claim 9 that further includes an independent heating means for selectively raising the temperature of the water stored in the storage tank.

11. The improvement of claim 8 wherein said control means is connected to a fan contained in the indoor fan coil unit and which is arranged to selectively inactivate the fan when the heat pump is in a heating mode of operation so that the entire heat of condensation is transferred from the condensing circuit into the water circuit.

* * * * *